US008416146B2

(12) United States Patent
Endou

(10) Patent No.: US 8,416,146 B2
(45) Date of Patent: Apr. 9, 2013

(54) ANTENNA DEVICE

(75) Inventor: Kenji Endou, Tokyo (JP)

(73) Assignee: TDK Corporation, Tokyo (JP)

( * ) Notice: Subject to any disclaimer, the term of this patent is extended or adjusted under 35 U.S.C. 154(b) by 554 days.

(21) Appl. No.: 12/714,902

(22) Filed: Mar. 1, 2010

(65) Prior Publication Data

US 2010/0225560 A1 Sep. 9, 2010

(30) Foreign Application Priority Data

Mar. 6, 2009 (JP) ..... 2009-052771

(51) Int. Cl.
*H01Q 1/42* (2006.01)
*H01Q 1/24* (2006.01)

(52) U.S. Cl.
USPC ..... 343/872; 343/702; 343/700 MS

(58) Field of Classification Search ..... None
See application file for complete search history.

(56) References Cited

U.S. PATENT DOCUMENTS

| | | | | |
|---|---|---|---|---|
| 6,323,811 | B1 * | 11/2001 | Tsubaki et al. | 343/700 MS |
| 2010/0127936 | A1 * | 5/2010 | Rao et al. | 343/700 MS |
| 2011/0073648 | A1 * | 3/2011 | Kobayashi et al. | 235/439 |
| 2011/0254745 | A1 * | 10/2011 | Tsujimura et al. | 343/702 |

FOREIGN PATENT DOCUMENTS

| | | |
|---|---|---|
| JP | 09-223916 | 8/1997 |
| JP | 2001-053528 | 2/2001 |
| JP | 2004-328108 | 11/2004 |
| JP | 2007-074585 | 3/2007 |

* cited by examiner

*Primary Examiner* — Trinh Dinh
(74) *Attorney, Agent, or Firm* — McDermott Will & Emery LLP

(57) ABSTRACT

An antenna element is formed by providing a radiation electrode on a base member made of a dielectric material. To protect the antenna element from external impact, a void is formed between a housing and the antenna element. This void is filled with a solid member. The relative permittivity of the solid member is equal to or higher than the relative permittivity of the housing, and equal to or lower than the relative permittivity of the base member. The solid member is formed as an elastic member.

5 Claims, 7 Drawing Sheets

ANTENNA DEVICE

RELATED APPLICATIONS

This application claims foreign priority under 35 U.S.C. §119 of Japanese Patent Application No. 2009-052771 filed on Mar. 6, 2009, the entire contents of which are incorporated herein by reference.

BACKGROUND OF THE INVENTION

1. Field of the Invention

The present invention relates to an antenna device, and more particularly to a technique for improving the radiation efficiency of an antenna device.

2. Description of the Related Art

An antenna element in a small-sized wireless terminal such as a portable telephone device is required to have a small size and high radiation efficiency. To satisfy both requirements, various efforts have been made to find the material suitable as a dielectric body forming the antenna element and determine the appropriate shape of a radiation electrode (see Japanese Patent Application Laid-Open Nos. 2001-53528 and 2007-74585).

In the case of a portable telephone device that is often carried around by the owner wherever he/she goes, the portable telephone device falling from the height of a breast pocket or the like onto the ground is a conceivable accident. In this case, a housing of the portable telephone device might be temporarily deformed, and the impact might be transmitted to the antenna element inside. With the resistance to impact applied from the outside (hereinafter referred to as the "impact resistance") being taken into consideration, a void (a margin) of approximately 1 mm is left between an antenna element and a housing, in general.

The inventor observed that the void for impact resistance might decrease the radiation efficiency of the antenna. The present invention has been developed based on the technical findings obtained through studies made on the relationship between the void and the radiation efficiency.

The present invention has been completed, with the above consideration by the inventor being the starting point. The main object of the present invention is to improve the radiation efficiency of a built-in antenna element.

SUMMARY

In one embodiment, there is provided an antenna device that includes an antenna element with a radiation electrode formed on an upper face of a base member made of a dielectric material; a housing that covers an upper face of the antenna element and is made of a resin material; and a solid member that is provided between the housing and the antenna element.

Here, the "upper face" may be the face on the opposite side from the fixed side of the antenna element, or on the opposite side from the mounting board, for example. The "solid member" may be made of a substance that has elasticity, viscosity, or plasticity, as long as it is solid. According to the embodiment, impact from the outside can be easily prevented from reaching the antenna element inside by virtue of the solid member inserted between the antenna element and the housing. Furthermore, since the void is fully or partially filled with the solid member, the radiation efficiency can be readily improved.

If the solid member is made of an elastic material, the solid member becomes a more effective buffer.

The solid member may be formed and secured between the antenna element and the housing by hardening a paste-like resin material applied to the antenna element.

In this case, the void between the antenna element and the housing can be certainly removed.

The solid member is preferably made of a material having relative permittivity that is equal to or higher than the relative permittivity of the housing. The solid member is also preferably made of a material having relative permittivity that is equal to or lower than the relative permittivity of the base member.

In this case, an electromagnetic wave radiated from the antenna element is discharged to the outside via the high-permittivity base member, the medium-permittivity solid member, and the low-permittivity housing. Accordingly, the permittivity in the electromagnetic wave propagation path changes smoothly, and the radiation efficiency can be more easily improved.

The solid member may be configured to cover only the electromagnetic wave radiating face of the antenna element and the upper portions of the side faces of the base member.

To improve the radiation efficiency of the antenna element, the solid member should exist at least in the propagation path of the electromagnetic wave radiated from the antenna element. Therefore, with the solid member covering only the electromagnetic wave radiating face and the upper portions of the side faces of the base member, both the radiation efficiency and the impact resistance can be easily improved, without excess usage of the solid member. Also, if the improved radiation efficiency is contributed to miniaturization of the antenna element while the usage of the solid member is suppressed, a portable telephone device or the like can be miniaturized.

The radiation electrode includes an upper-face electrode formed on the upper face of the base member and a side-face electrode formed on the side face of the base member. The side-face electrode has a gap in the lower-face portion of the side face, and the solid member may cover the antenna element while not hindering exposure of the gap.

In many antenna elements, two or more electrodes are provided on the base member so as to face one another via the gap. If the gap is covered with the solid member, a change is caused in the radiation characteristics of the antenna element. Therefore, the solid member should cover only the regions excluding the gap, or the solid member should not hinder exposure of the gap.

As described above, according to the present invention, the radiation efficiency of a built-in antenna element can be readily improved.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

The following is a detailed description of a preferred embodiment of the present invention, with reference to the accompanying drawings. In this embodiment, an antenna element that is built in a portable telephone device is described. The portable telephone device containing the antenna element is formed as an antenna device.

Figure 1:
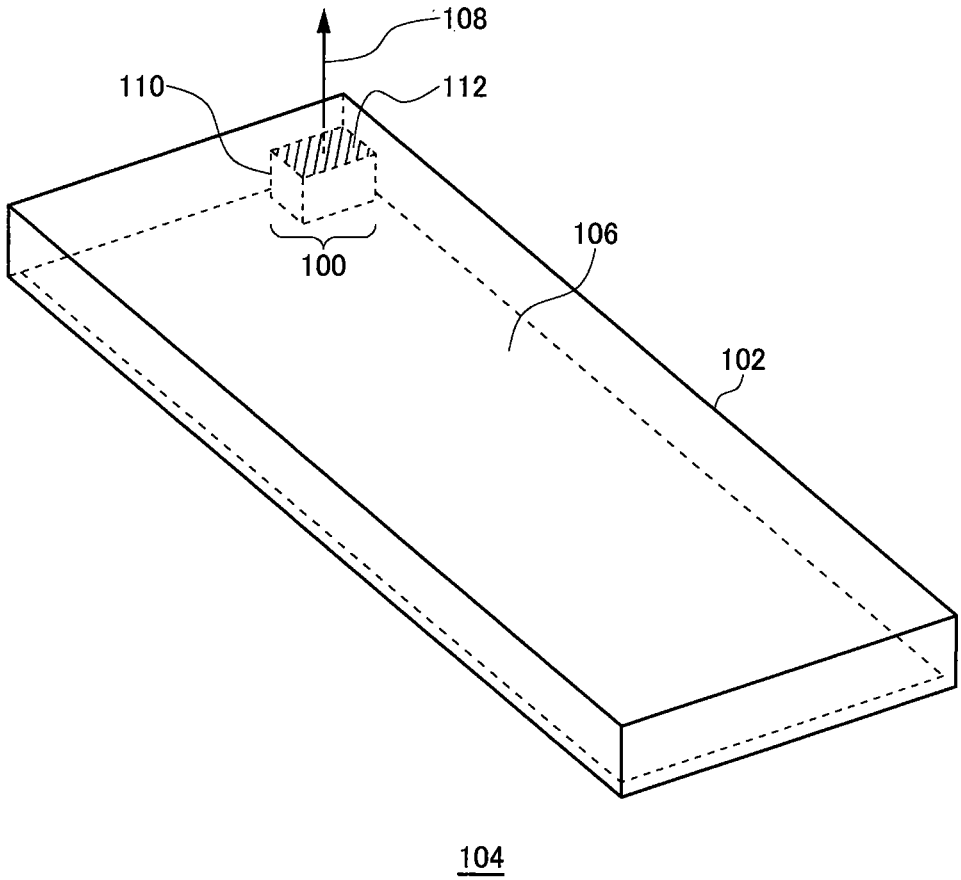
FIG. 1 is an external view of a portable telephone device that contains an antenna element.

FIG. 1 is an external view of a portable telephone device 104 that contains an antenna element 100. In the portable telephone device 104, a mounting board 106 is hermetically closed in a housing 102. The antenna element 100 is placed on the mounting board 106. Accordingly, the antenna element 100 is also hermetically closed in the housing 102. In FIG. 1, the thickness of the housing 102 is not shown, but it is approximately 1 mm in practice. The antenna element 100 is formed with a base member 110 made of a dielectric material, and a radiation electrode 112 is formed on the base member 110. More specifically, the radiation electrode 112 is formed by paste-printing silver, copper, or the like on a dielectric member made of a ceramic material.

This embodiment concerns the electromagnetic wave radiated in the direction indicated by an arrow 108 in FIG. 1, or the direction opposite from the face attached onto the mounting board 106. This electromagnetic wave is radiated from the radiation electrode 112 of the antenna element 100, and passes through the housing 102 to the outside. At the time of reception, the electromagnetic wave entering from the outside passes through the housing 102, and reaches the radiation electrode 112 of the antenna element 100.

Figure 2:
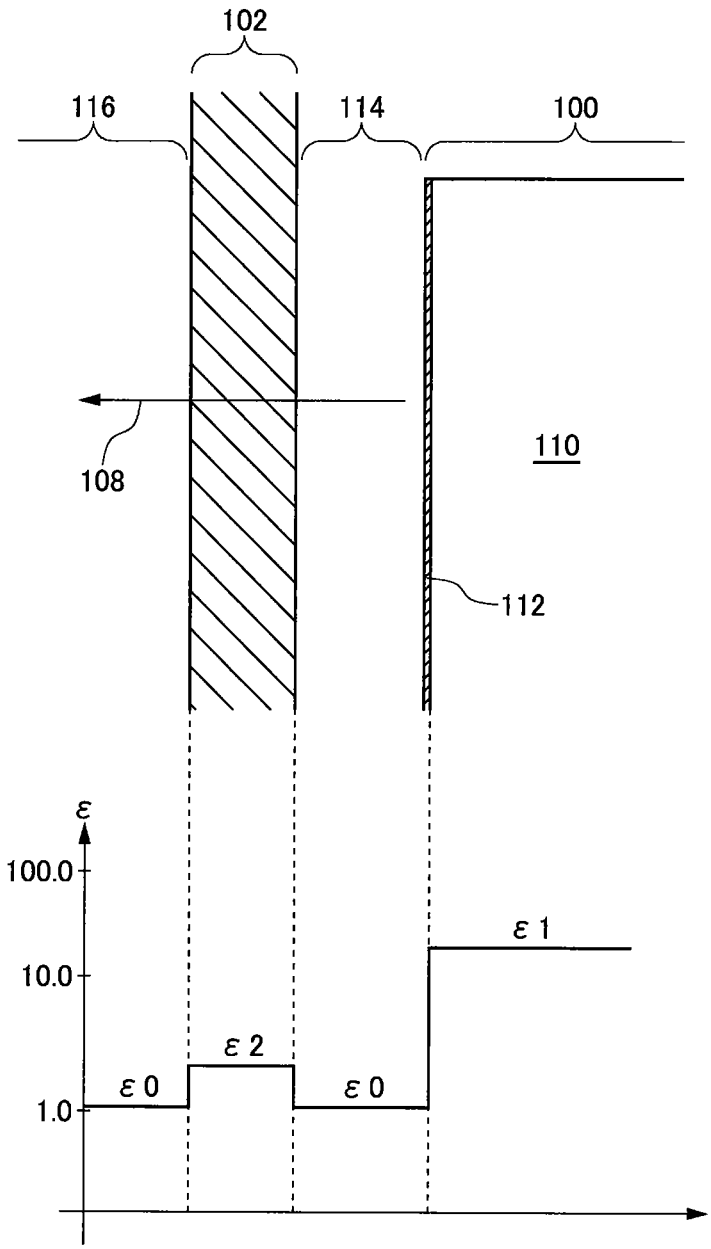
FIG. 2 is a schematic view for explaining a normal propagation path of the electromagnetic wave radiated from the antenna element to the outside.

FIG. 2 is a schematic view for explaining a normal propagation path of the electromagnetic wave radiated from the antenna element 100 to the outside. FIG. 2 is an enlarged view of the vicinity of the antenna element 100 of FIG. 1, particularly, the vicinity of the housing 102 seen along the arrow 108 from above the antenna element 100. In the following, the normal relationship between the antenna element 100 and the housing 102 is described, and the problems with the relationship are pointed out.

In general, an air layer 114 (a void) for impact resistance is provided between the antenna element 100 and the housing 102. Here, the relative permittivity of the base member 110 is represented by $\in 1$, the relative permittivity of the air layer 114 is represented by $\in 0$, and the relative permittivity of the housing 102 is represented by $\in 2$. Since an outside region 116 is normally filled with air, the relative permittivity of the outside region 116 is also $\in 0$. More specifically, the relative permittivity $\in 1$ of the base member 110, or the relative permittivity $\in 1$ of the antenna element 100, is 5.0 to 20.0, the relative permittivity $\in 0$ of the air layer 114 and the outside region 116 is approximately 1.0, and the relative permittivity $\in 2$ of the housing 102 is 3.0. To achieve a wavelength shortening effect, the antenna element 100 is often made of a material with high permittivity. The permittivity of the housing 102 that is made of a resin such as polycarbonate is normally higher than the permittivity of air, but is not as high as the permittivity of the antenna element 100.

The graph shown in the lower half of FIG. 2 indicates the relationship in relative permittivity among the antenna element 100, the air layer 114, the housing 102, and the outside region 116. As can be seen from the graph, the electromagnetic wave radiated from the antenna element 100 enters the region of the lowest relative permittivity $\in 0$ (the air layer 114) from the region of the highest relative permittivity $\in 1$ (the base member 110), and passes through the region of the medium relative permittivity $\in 2$ between $\in 1$ and $\in 0$ (the housing 102), to reach the region of the relative permittivity $\in 0$ (the outside region 116). At the time of reception, the electromagnetic wave travels in the opposite direction.

In this normal electromagnetic wave radiation path, the variation of the permittivity before the electromagnetic wave reaches the outside region 116 is large. The inventor assumed that the antenna radiation efficiency became lower due to the large variation of relative permittivity.

Figure 3:
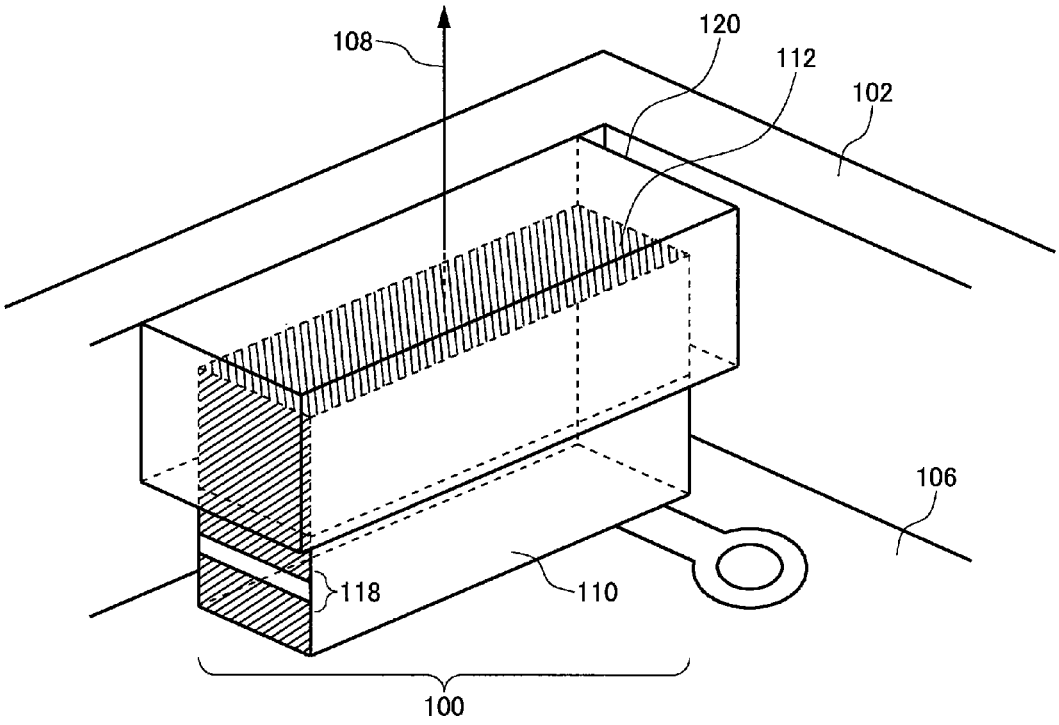
FIG. 3 is an external view of the antenna element according to the present embodiment.

FIG. 3 is an external view of the antenna element 100 according to the present embodiment. The antenna element 100 according to the present embodiment may be the same as the conventional antenna element 100. A gap 118 is provided on a side face of the antenna element 100. In this embodiment, the upper face of the antenna element 100 is covered with a solid member 120. The relative permittivity $\in 3$ of the solid member 120 is preferably equal to or higher than the relative permittivity $\in 2$ of the housing 102, and equal to or lower than the relative permittivity $\in 1$ of the antenna element 100. In any case, the relative permittivity $\in 3$ of the solid member 120 should smooth the variation between the relative permittivity $\in 1$ of the antenna element 100 and the relative permittivity $\in 2$ of the housing 102.

The solid member 120 may also cover the side faces of the antenna element 100. However, to reduce the influence on the fundamental characteristics of the antenna element 100, the solid member 120 does not cover the gap 118. In other words, the gap 118 is in direct contact with air. Furthermore, if the solid member 120 reaches the mounting board 106, the electric characteristics of the antenna element 100 and the mounting board 106 are greatly affected. Therefore, the solid member 120 should preferably cover only the upper portion of the antenna element 100. Although the material of the solid member 120 is not particularly limited, the solid member 120 in this embodiment is made of a material having the relative permittivity $\in 3$ that is equal to or higher than the relative permittivity $\in 0$ of air and equal to or lower than the relative permittivity $\in 1$ of the antenna element 100.

Figure 4:
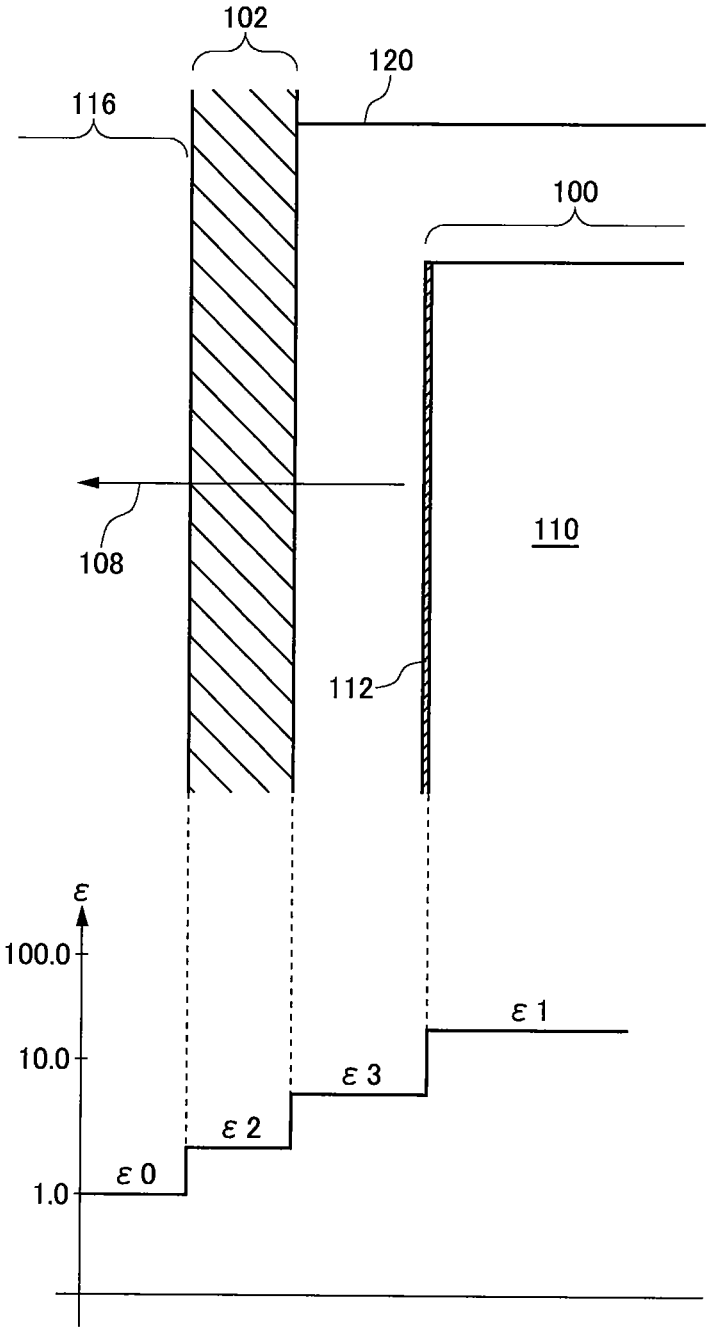
FIG. 4 is a schematic view for explaining the propagation path of the electromagnetic wave radiated from the antenna element to the outside according to the present embodiment.

FIG. 4 is a schematic view for explaining the propagation path of the electromagnetic wave radiated from the antenna element 100 to the outside according to the present embodiment. FIG. 4 is also an enlarged view of the vicinity of the antenna element 100 of FIG. 1, particularly, the vicinity of the housing 102 seen along the arrow 108 from above the antenna element 100. In this embodiment, the space between the antenna element 100 and the housing 102 is filled with the solid member 120, instead of the air layer 114 (a void).

Here, the relative permittivity of the solid member 120 is $\in 3$ ($\in 2 \leqq \in 3 \leqq \in 1$). The graph shown in the lower half of FIG. 4 indicates the relationship in relative permittivity among the antenna element 100, the solid member 120, the housing 102, and the outside region 116. As can be seen from this graph, the electromagnetic wave radiated from the antenna element 100 enters the region of the relative permittivity $\in 3$ (the solid member 120) lower than the relative permittivity $\in 1$ from the region of the highest relative permittivity $\in 1$ (the base member 110), and passes through the region of the relative permittivity ∈2 (the housing 102) lower than the relative permittivity ∈3, to reach the region of the lowest relative permittivity (the outside region 116). At the time of reception, the electromagnetic wave travels in the opposite direction.

In the electromagnetic wave radiation path in this embodiment, the permittivity varies stepwise before the electromagnetic wave reaches the outside region 116. Accordingly, the variation of the permittivity is smaller than in the general case described with reference to FIG. 2.

In this embodiment, the solid member 120 also serves as a buffer, so that the external force acting on the housing 102 is not transmitted directly to the antenna element 100. Accordingly, the solid member 120 is also effective in protecting the antenna element 100 from the external force acting on the housing 102. Particularly, if the solid member 120 is made of an elastic material such as silicone rubber, higher impact resistance can be more effectively achieved.

As shown in FIG. 3, the solid member 120 may be formed as a parallelepiped member having a concavity formed therein. The upper portion of the antenna element 100 may be housed in the concavity. Alternatively, a resin material in a paste-like state is applied to the antenna element 100, and is hardened to form the solid member 120. In the latter case, the solid member 120 in a viscous state is applied, and accordingly, the space between the antenna element 100 and the housing 102 is more efficiently filled.

Based on the embodiment, the method for increasing the radiation efficiency of the portable telephone device 104 has been described above. By inserting the solid member 120 between the housing 102 and the antenna element 100, the variation of the permittivity in the electromagnetic wave propagation path extending from the antenna element 100 to the outside region 116 can be made smaller, and higher radiation efficiency can be achieved. Also, since the solid member 120 serves as a buffer, the antenna element can be easily protected from external force. Particularly, if the base member 120 is made of an elastic material, a greater protecting effect can be achieved. Also, a resin material in a paste-like state is applied to the antenna element 100, and is hardened to form the solid member 120. In this manner, the air layer 114 can be easily eliminated.

It is preferable to insert the solid member 120 so as to completely eliminate the air layer 114. However, by simply reducing the width of the air layer 114 by the solid member 120, the radiation efficiency can be made higher than in a case where the solid member 120 does not exist. Therefore, the solid member 120 is not necessarily in contact with both the housing 102 and the radiation electrode 112, and the solid member 120 may be in contact only with the housing 102 or the radiation electrode 112. Particularly, when the electromagnetic wave from the antenna element 100 enters the air layer 114, the relative permittivity greatly varies from ∈1 to ∈0. Therefore, at least the antenna element 100 should preferably be brought into secure contact with the solid member 120, so as not to cause a large variation.

In a case where the air layer 114 is not completely replaced with the solid member 120 but is partially left, the solid member 120 may not necessarily be made of an elastic material. In this manner, the air layer 114 prevents impact from transmitting from the housing 102 directly to the antenna element 100, though the air layer 114 becomes thinner. Also, the entire solid member 120 may not be made of an elastic material. For example, the solid member 120 may be formed by sandwiching an elastic material with two inelastic layers. The inelastic layers are preferably formed by selecting an optimum material from known materials such as quartz and aluminum oxide through experiments.

The relative permittivity ∈3 of the solid member 120 may not be a fixed value as shown in FIG. 4. For example, the permittivity may gradually become lower in the direction from the antenna element 100 toward the housing 102.

The relative permittivity ∈3 of the solid member 120 is preferably equal to or higher than the relative permittivity ∈2 of the housing 102. However, as long as the relative permittivity ∈3 is equal to or higher than the relative permittivity ∈0 of the air layer 114, the variation of the relative permittivity in the radiation propagation path can be made smaller than in the general embodiment described with reference to FIG. 3. Likewise, the relative permittivity ∈3 of the solid member 120 is preferably equal to or lower than the relative permittivity ∈1 of the base member 110. However, the variation of the relative permittivity can also be made smaller than in the general embodiment described with reference to FIG. 3, as long as the total value of the variation from the relative permittivity ∈1 of the base member 110 to the relative permittivity ∈0 of the air layer 114 and the variation from the relative permittivity ∈0 to the relative permittivity ∈2 of the housing 102 is greater than the total value of the variation from the relative permittivity ∈1 of the base member 110 to the relative permittivity ∈3 of the solid member 120 and the variation from the relative permittivity ∈3 to the relative permittivity ∈2 of the housing 102. Accordingly, a certain effect can be expected when the relative permittivity ∈3 of the solid member 120 is higher than the relative permittivity ∈1 of the base member 110.

Also, if the solid member 120 covers only the radiation electrode 112 of the antenna element 100 and the upper portions of the side faces of the antenna element 100, higher radiation efficiency and impact resistance can be readily achieved while the usage of the solid member 120 is suppressed.

The embodiment of the present invention has been described so far. The embodiment is merely an example, and it is obvious to those skilled in the art that various changes and modifications may be made to the embodiment within the scope of the invention, and those changes and modifications are also within the scope of claims. Therefore, the description in the specification and the drawings should be regarded as illustrative, not as restrictive.

Example 1

Figure 5:
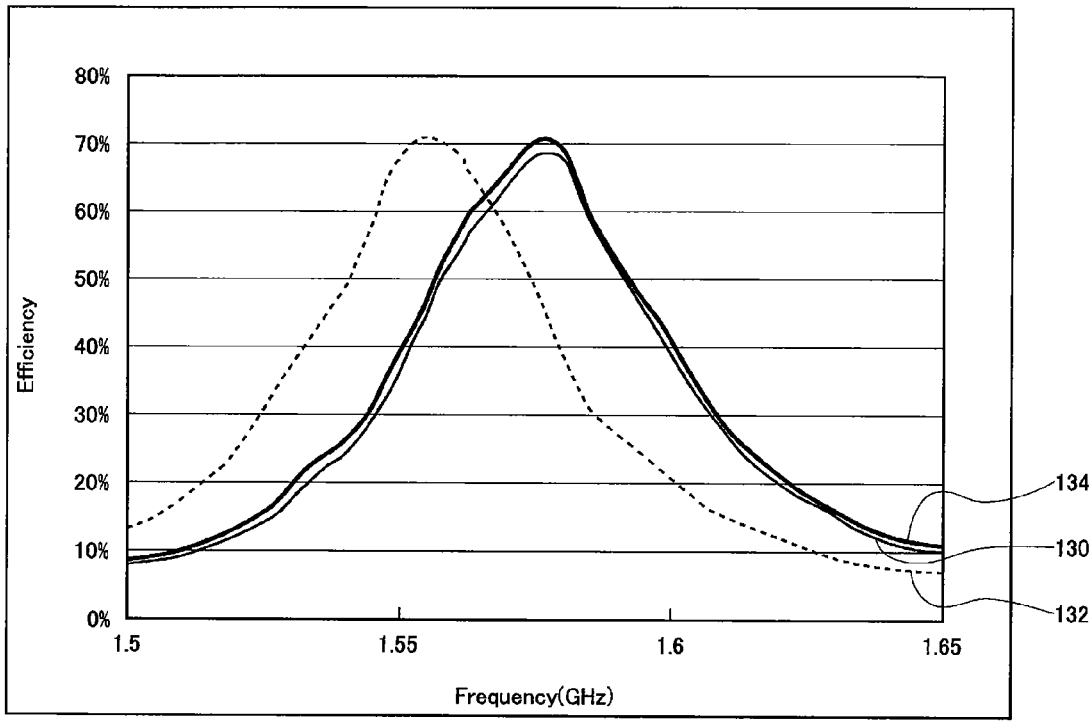
FIG. 5 is a graph showing the results of measurement of variations of radiation efficiency depending on the existence of the solid member.

FIG. 5 is a graph showing the results of measurement of variations of radiation efficiency depending on the existence of the solid member 120. An experiment is conducted to verify whether the electromagnetic wave radiation efficiency of the antenna device is actually improved by virtue of the existence of the solid member 120. The size of the housing 102 used in the experiment is 112 mm long, 52 mm wide, and 15 mm tall. The thickness of the housing 102 is 1 mm. The material of the housing 102 is polycarbonate. In the housing 102, the mounting board 106 that is 100 mm long, 40 mm wide, and 1 mm thick is placed. The antenna element 100 that is 12 mm long, 2.5 mm wide, and 4.5 mm tall is placed on the mounting board 106. The antenna element 100 is formed of a conventional ceramic material. The width of the void (the air layer 114) between the antenna element 100 and the housing 102 is 1 mm.

Figure 7:
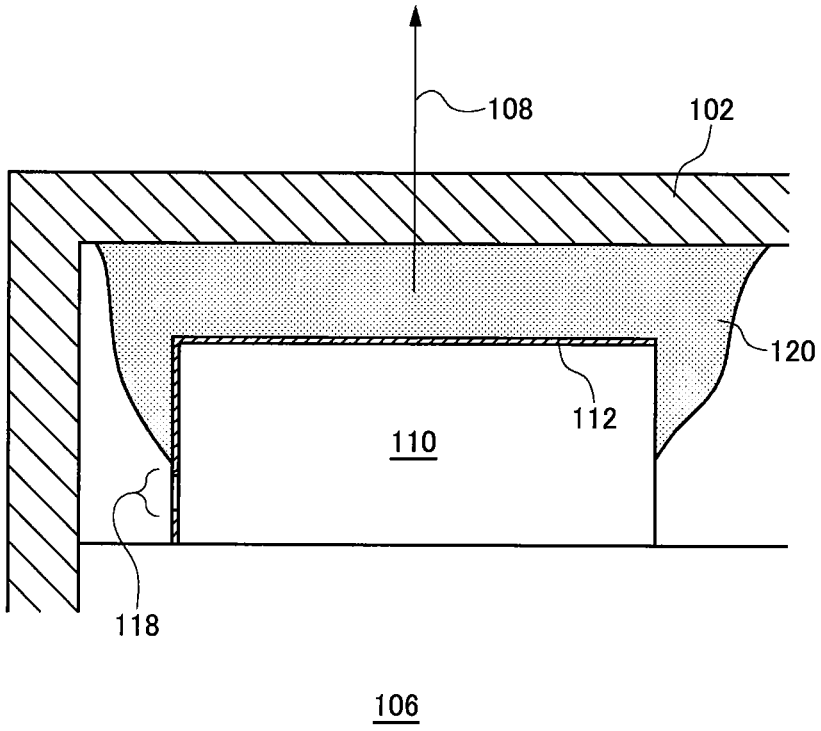
FIG. 7 is a schematic view showing the relationship of the solid member, the antenna element and the housing, according to FIG. 5.

As the solid member 120, silicone rubber (KE347T of Shin-Etsu Silicones) is used. The relative permittivity of the silicone rubber at 50 Hz is 2.9 according to the catalog published by the manufacturer. The silicone rubber in a paste-like state is applied to the radiation electrode 112 of the antenna element 100, to form the solid member 120 covering the radiation electrode 112 of the antenna element 100. FIG. 7 shows the specific structure of the antenna element. The solid member 120 does not hinder exposure of the gap 118. This antenna element 100 is designed to be used as a GPS (Global Positioning System) antenna and adjusted to have the largest gain at 1575 MHz.

In FIG. 5, the abscissa axis indicates the frequency, and the ordinate axis indicates the radiation efficiency (radiation power/input power). A graph 130 indicated by the thin solid line represents the relationship between the radiation efficiency of the antenna element 100 and the frequency in a case where the solid member 120 is not provided. In this case, the highest radiation efficiency is 69%. A graph 132 indicated by the dotted line represents the relationship between the radiation efficiency of the antenna element 100 and the frequency in a case where the solid member 120 is provided. Because of the influence of the solid member 120, the resonance frequency is reduced by approximately 20 MHz. This reduction in resonance frequency is corrected by adjusting the antenna element, and the peak of the resonance frequency is matched with the peak of the graph 130, to obtain a graph 134. In the case of the graph 134, the highest radiation efficiency is 71%. By providing the solid member 120, the radiation efficiency is improved by approximately 2%. The frequency bandwidth also becomes greater.

In this experiment, silicone rubber is applied from a tube to a bamboo skewer, and the silicon rubber is applied onto the base member 100 from the bamboo skewer. Depending on the amount and application position of the silicon rubber, the influence on the frequency varies. Accordingly, at the time of mass production, the silicone rubber is put into a syringe, and the discharge amount should preferably be controlled by adjusting the air pressure and the discharging time. Likewise, the application position should preferably be stabilized by marking or with the use of a jig.

Example 2

Figure 6:
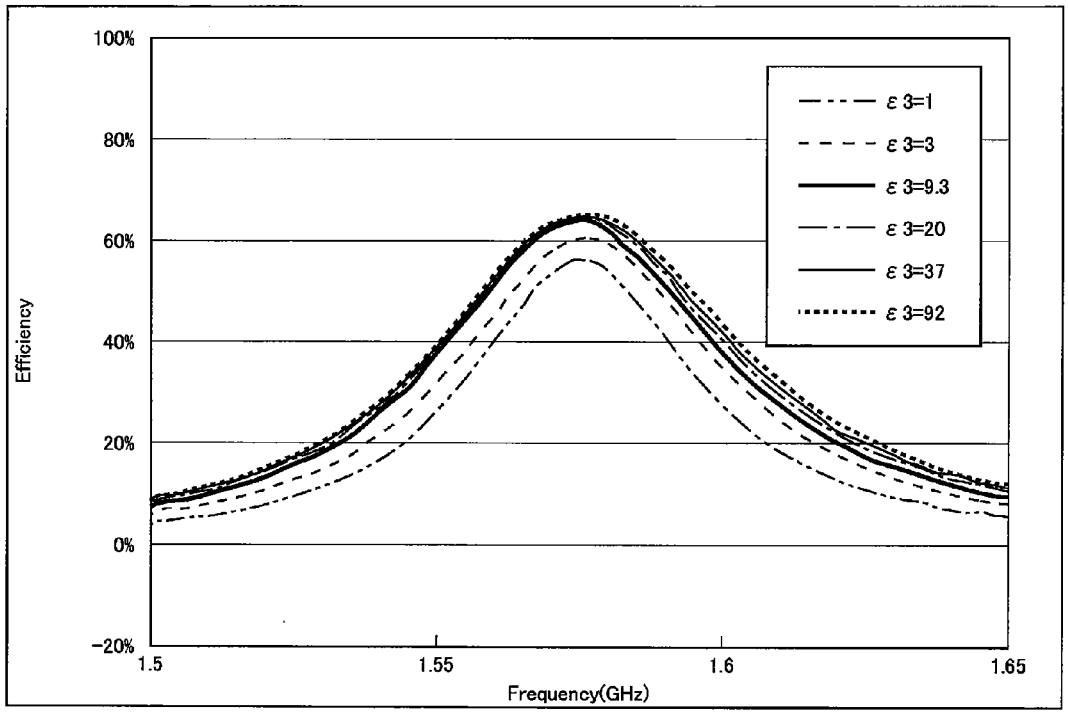
FIG. 6 is a graph showing the results of calculations performed to determine the variations of radiation efficiency depending on the material of the solid member.

FIG. 6 is a graph showing the results of calculations performed to determine the variations of radiation efficiency depending on the material of the solid member 120. A simulation is performed to examine how the radiation efficiency varies when the relative permittivity $\in$3 of the solid member 120 is changed. As a simulator, Version 10 of HFSS (manufactured by Ansoft Japan K.K.) is used. The housing 102, the mounting board 106, and the antenna element 100 have the same sizes as in the settings in the experiment described with reference to FIG. 5.

The graph corresponding to the relative permittivity $\in$3=1 indicates the state observed in a case where the solid member 120 is not inserted. When the solid member 120 having the relative permittivity $\in$3=3 or 20 is inserted, the radiation efficiency is greatly improved. When the solid member 120 having the relative permittivity $\in$3=20 or more is inserted, the radiation efficiency is no longer improved as much. It is also considered that, when the relative permittivity $\in$3 of the solid member 120 is very high, the electric loss (tan $\delta$) and the electric temperature characteristics ($\in$) of the solid member 120 might affect the frequency characteristics of the antenna element 100. Therefore, the upper limit of the relative permittivity $\in$3 of the solid member 120 should preferably be equal to the relative permittivity $\in$1 of the base member 110. Accordingly, the relative permittivity $\in$3 of the solid member 120 is preferably equal to or higher than the relative permittivity $\in$2 of the housing 102, and equal to or lower than the relative permittivity $\in$1 of the base member 110.

What is claimed is:

1. An antenna device comprising:

an antenna element with a radiation electrode formed at least on an upper face of a base member made of a dielectric material, the antenna element having an electromagnetic wave radiating face;

a housing that covers an upper face of the antenna element and is made of a resin material; and a solid member that is provided between the housing and the antenna element, wherein:

the solid member is configured to cover only the electromagnetic wave radiating face of the antenna element and upper portions of side faces of the base member, the radiation electrode includes an upper-face electrode formed on the upper face of the base member and a side-face electrode formed on at least one of the side faces of the base member, the side-face electrode is configured to have a gap in a lower-face portion of the at least one of the side faces, and the solid member covers the antenna element while not hindering exposure of the gap.

2. The antenna device as claimed in claim 1, wherein the solid member is made of an elastic material.

3. The antenna device as claimed in claim 2, wherein the solid member is formed and secured between the antenna element and the housing by hardening a paste-like resin material applied to the antenna element.

4. The antenna device as claimed in claim 1, wherein the solid member is made of a material having relative permittivity that is equal to or higher than relative permittivity of the housing.

5. The antenna device as claimed in claim 1, wherein the solid member is made of a material having relative permittivity that is equal to or lower than relative permittivity of the base member.

* * * * *